US005532791A

United States Patent [19]

Takahashi et al.

[11] Patent Number: 5,532,791

[45] Date of Patent: Jul. 2, 1996

[54] ERROR DETECTION APPARATUS FOR DETECTING ERRORS OF TONER SENSING IN AN IMAGE FORMING APPARATUS

[75] Inventors: Yasuhito Takahashi; Tsutomu Kimura, both of Ebina; Toru Isosu, Iwatsuki, all of Japan

[73] Assignee: Fuji Xerox Co., Ltd., Tokyo, Japan

[21] Appl. No.: 320,261

[22] Filed: Oct. 11, 1994

[30] Foreign Application Priority Data

Dec. 20, 1993 [JP] Japan ..... 5-319749

[51] Int. Cl.[6] ..... G03G 21/00

[52] U.S. Cl. ..... 355/206; 355/208; 355/246

[58] Field of Search ..... 355/203, 204, 355/206, 208, 209, 246; 118/688, 689, 691, 694

[56] References Cited

U.S. PATENT DOCUMENTS

| | | | |
|---|---|---|---|
| 5,036,363 | 7/1991 | Iida et al. | 355/246 |
| 5,160,966 | 11/1992 | Shiina et al. | 355/206 |
| 5,162,848 | 11/1992 | Saitoh et al. | 355/206 |
| 5,216,464 | 6/1993 | Kotani et al. | 355/208 |
| 5,227,847 | 7/1993 | Motohashi et al. | 355/246 X |
| 5,237,372 | 8/1993 | Ishii et al. | 355/246 |
| 5,317,369 | 5/1994 | Nakanishi | 355/208 |

FOREIGN PATENT DOCUMENTS 1-288876 11/1989 Japan .

3-267966 11/1991 Japan .

*Primary Examiner*—William J. Royer
*Attorney, Agent, or Firm*—Oliff & Berridge

[57] ABSTRACT

An error detection apparatus for use with an image forming apparatus prevents damage to the image forming apparatus that results from toner sensor error. The image forming apparatus includes a developer housing positioned opposite to a photosensitive body; a toner box for supplying monocomponent toner to the developer housing; a developer roller for developing an electrostatic latent image on the photosensitive body in the developer housing; a toner transport and supply member for transporting and supplying the monocomponent toner to the developing roller; and a toner sensor for detecting either the presence or the absence of the monocomponent toner in at least one of the developer housing and the toner box. The error detection apparatus includes a first counter for counting the number of either prints or image signals while a toner-present signal is being detected continuously from the toner sensor; a second counter for counting the number of either prints or image signals while a toner-absent signal is being detected continuously from the toner sensor; and a display and stopping unit for stopping the operation of the image forming apparatus and displaying an error indication concurrently if the sum of the values counted by the first and the second counter has exceeded a predetermined value.

3 Claims, 10 Drawing Sheets

ERROR DETECTION APPARATUS FOR DETECTING ERRORS OF TONER SENSING IN AN IMAGE FORMING APPARATUS

BACKGROUND OF THE INVENTION

1. Field of the Invention

The present invention relates to an error detection apparatus for use with electrophotographic image forming apparatuses such as copiers, facsimile machines and printers, the error detection apparatus preventing image defects and damage to component parts attributable to a failure of the toner sensor for detecting the presence or absence of toner in the developing unit of the apparatus.

2. Description of the Related Art

One typical image forming apparatus is the remote printer that continuously records image data 24 hours a day, the data being received from a host computer or the like. This kind of printer has its toner housing filled with as much toner as can be accommodated so as to make a large number of copies or prints on a continuous basis. In such a setup, the developing unit of the printer incorporates a toner sensor that detects the presence or absence of toner. When the toner sensor detects the absence of toner, a display unit attached to the printer is activated to display a prompt message for toner replenishment. At the same time, the remaining toner in the developing unit is utilized to continue the image recording operation. When a predetermined number of prints has been completed, the printer is brought to a stop.

As shown in FIG. 2, the detection signal from the toner sensor is typically made of a high level signal 100 and a low level signal 101. The high level signal 100 is output when toner is detected on the surface of the toner sensor; the low level signal 101 is output when toner is found absent. The high or low level signal 100 or 101 is not merely output when toner is found present or absent in the developing unit; such signals may also be triggered erroneously. A sensor cleaning member is provided which operates in synchronism with an agitator to keep the sensor surface free of toner. In this arrangement, a rotating agitator operates the sensor cleaning member concurrently, often causing the toner sensor to detect the presence or absence of toner erroneously. Furthermore, since toner is consumed every time a print or a copy is made, a subsequent toner-replenishing action can cause the toner sensor to detect the presence or absence of toner incorrectly.

One solution to the above problem is the system proposed in Japanese Patents Laid-open Nos. Hei 1-288876 and Hei 3-267966. The proposed system involves checking the signal from a toner sensor arrangement at intervals of 100 ms. This system defines as a toner-absent state the state in which the low level signal 101 indicating the absence of toner is output continuously for 1000 ms or longer. As depicted in FIG. 14, the proposed system comprises three different means: counting means for counting the number of prints made while the toner-absent state is being detected by the toner sensor arrangement (steps 1→2→3→4→5→6→7→8→10→6): subtracting means for subtracting from the above count value the number of prints made after the toner sensor arrangement has stopped detecting the absence of toner (steps 6→7→8→9→2); and stopping means (step 16) for stopping the machine when the number of prints made has reached a predetermined count value (step 6).

The developing unit of the conventional system above has its toner sensor arrangement composed of a first and a second toner sensor. The first toner sensor detects the absence of toner in a developer housing, and the second toner sensor detects the absence of toner in a toner box. When the first toner sensor detects a toner-absent state, a toner dispensing motor is driven until the developer housing is replenished sufficiently with toner. A toner-present state being detected means that the developer housing contains a sufficient amount of toner. In this state, the toner dispensing motor is held inactive.

Everything is fine as long as the toner sensors work properly for toner detection. Problems arise if a toner sensor itself fails; if a sensor cleaning member peels, breaks or bends, causing the toner sensor to act erroneously; or if any harness is severed or any connector is unplugged. Illustratively, the first toner sensor itself can fail either electrically due to static electricity (charges accumulated in toner triggering a leak), or mechanically (sensor surface damaged by a deformed cleaning member). A toner cleaning member being peeled, broken or bent can leave toner deposited on the sensor surface. This may cause the first toner sensor incorrectly to detect the presence of toner even though the developer housing does not have enough toner inside. A severed harness or an unplugged connector may be brought about inadvertently by the user or service engineer servicing the developing unit or the like.

If any of the troubles above occurs, the first toner sensor incorrectly detects either the presence or the absence of toner. Erroneous detection of two cases is possible by use of appropriate software. One of the two erroneously detectable cases is one in which the presence of toner is continuously detected even though the developer housing actually does not have a sufficient amount of toner inside. In this case, the toner dispensing motor remains inactive and no toner is supplied. As a result, the residual toner is consumed by the ongoing copy or print operation. Soon the copies or prints coming out of the machine have blank portions; eventually nothing is copied or printed on the paper.

The other erroneously detectable case is one in which the absence of toner is continuously detected even though the developer housing contains toner inside. In this case, the toner dispensing motor remains active so that the housing is replenished with excess toner. Soon the developer housing is filled with toner; eventually excess loads either damage the toner dispensing motor or destroy the developer housing. In either case, the quality of copies or prints drops drastically, or mechanical failure such as a damaged motor or a destroyed developer housing results.

The same applies to the second toner sensor on the toner box side. If the second toner sensor fails, the presence of toner is erroneously detected in the toner box. Thus the prompt message for toner replenishment does not appear even though the toner cartridge has no toner inside. The toner sensor then detects a toner-absent state and issues orders to drive the toner dispensing motor. But toner is not supplied, with the result that subsequent copies or prints include growing blank portions. Eventually nothing is copied or printed on the paper. The same eventuality can also happen if the toner dispensing motor fails. If the toner dispensing motor stops running because of a severed harness or an unplugged connector, no toner is supplied to the developer housing. Soon the copies or prints coming out of the machine have blank portions; eventually nothing is copied or printed on the paper.

SUMMARY OF THE INVENTION

It is therefore an object of the present invention to overcome the above deficiencies and disadvantage of the prior art and to provide an error detection apparatus for use with image forming apparatuses, the error detection apparatus acting unfailingly to prevent the degradation of image quality or the destruction of component parts stemming from a toner sensor failing to detect correctly the presence or absence of toner in the developing unit in case of a failure of the toner sensor itself, a failed toner dispensing motor, a severed harness, an unplugged connector, or a failed PCB.

In carrying out the invention and according to one aspect thereof, there is provided an error detection apparatus for use with an image forming apparatus comprising: a developer housing positioned opposite to a photosensitive body; a toner box for supplying monocomponent toner to the developer housing; a developing roller for developing an electrostatic latent image on the photosensitive body in the developer housing; a toner transport and supply member for transporting and supplying the monocomponent toner to the developing roller; and a toner sensor for detecting either the presence or the absence of the monocomponent toner in at least one of the developer housing and the toner box. The error detection apparatus includes: first counting device for counting the number of either prints or image signals while a toner-present signal is being detected continuously from the toner sensor; second counting device for counting the number of either prints or image signals while a toner-absent signal is being detected continuously from the toner sensor; and display and stopping apparatus for stopping the operation of the image forming apparatus and displaying an error indication concurrently if the sum of the values counted by the first and the second counting device has exceeded a predetermined value. Preferably, the first and the second counting device perform counting operations when either the toner-present signal or the toner-absent signal is being detected continuously in synchronism with a print cycle.

According to another aspect of the invention, there is provided an error detection apparatus for use with an image forming apparatus, the error detection apparatus comprising: a developing unit; a toner sensor having a toner sensing surface furnished inside the developing unit, the toner sensor outputting continuously either a toner-present or a toner-absent signal depending on either the presence or the absence of toner contacting the toner sensing surface; a cleaning member for cleaning the toner sensing surface periodically; output image quantity counting device for taking a count representing the quantity of images output when either the toner-present signal or the toner-absent signal is being output continuously from the toner sensor; and display and stopping apparatus for stopping the operation of the image forming apparatus and displaying an error indication, either singly or in combination, if the quantity of the output images has exceeded a predetermined value.

In operation, the error detection apparatus of the invention has the first counting apparatus count the number of prints while the toner-present signal is being detected continuously from the toner sensor, and has the second counting device count the number of prints while the toner-absent signal is being detected continuously from the toner sensor. The apparatus detects the presence or absence of toner if the sum of the values counted by the first and the second counting device has exceeded a predetermined value.

Furthermore, the error detection apparatus of the invention has the output image quantity counting device make a count representing the quantity of images output when either the toner-present signal or the toner-absent signal is being output continuously from the toner sensor. The apparatus detects the presence or absence of toner if the quantity of the output images has exceeded a predetermined value.

Other objects, features and advantages of the present invention will become apparent in the following specification and accompanying drawings.

DESCRIPTION OF THE PREFERRED EMBODIMENTS

Figure 5:
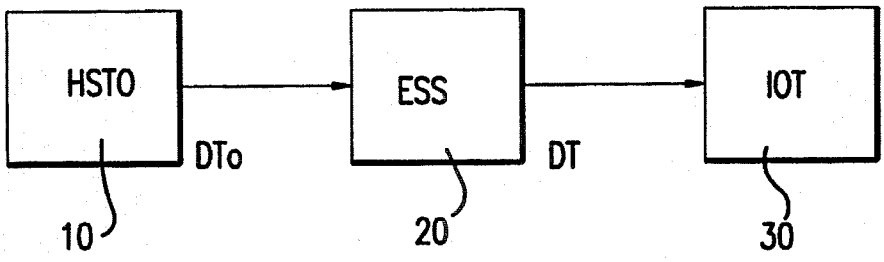
FIG. 5 is a block diagram of a typical image forming apparatus for use with the embodiment, the diagram showing how a remote printer (image forming apparatus) is connected to the embodiment.
Figure 6:
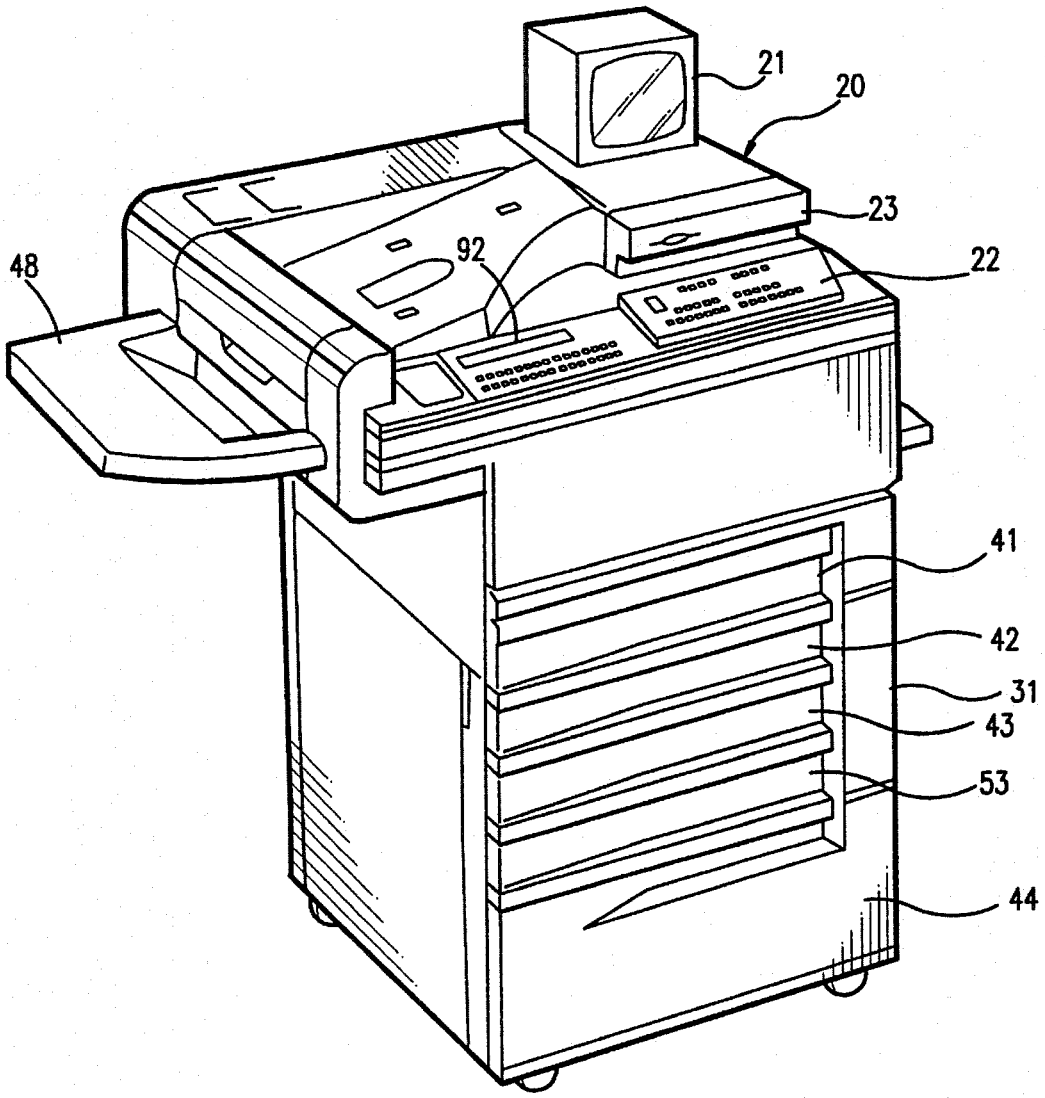
FIG. 6 is a perspective view of the remote printer.
Figure 7:
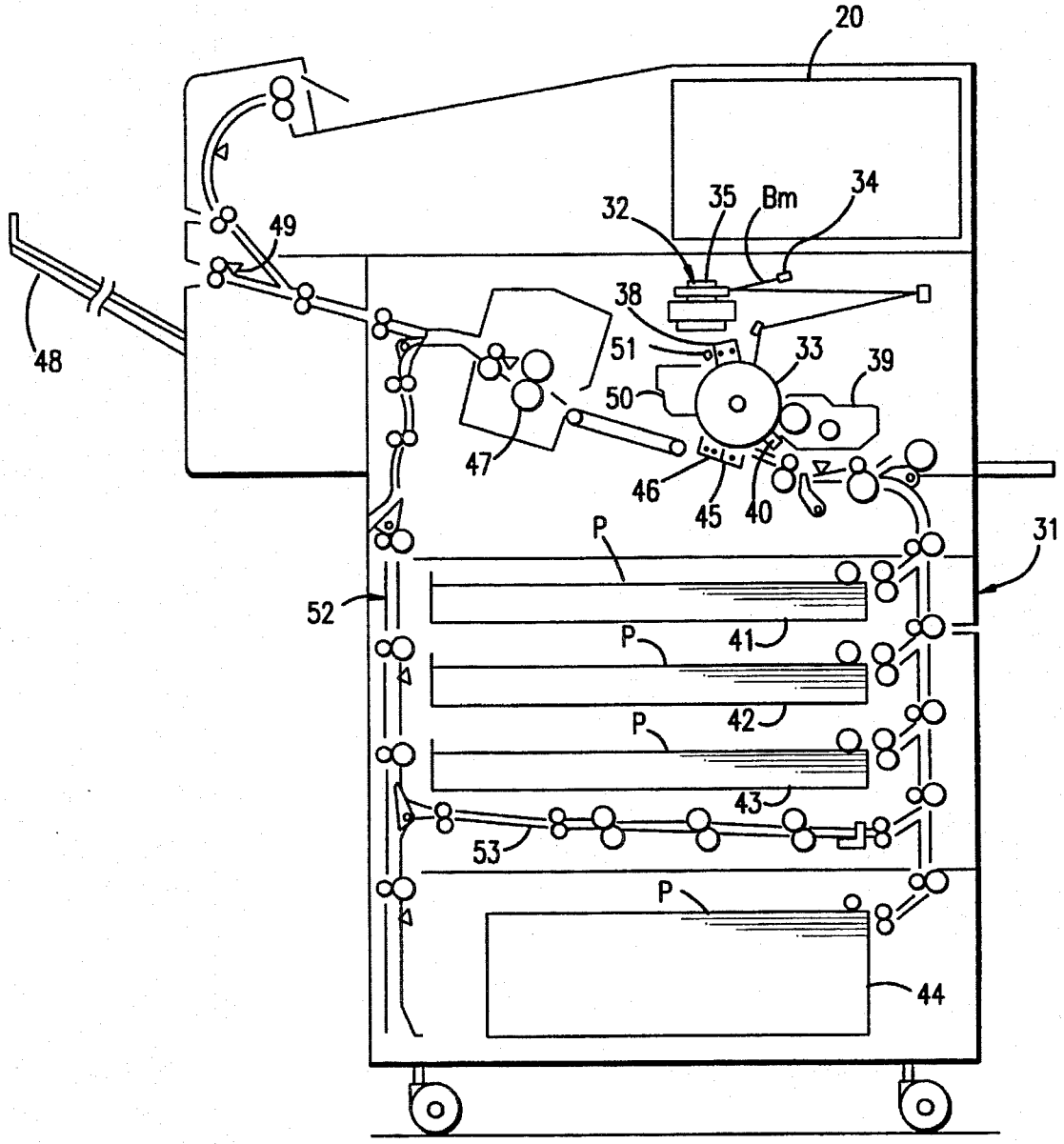
FIG. 7 is a schematic view outlining the constitution of the remote printer.

Preferred embodiments of the invention will now be described with reference to the accompanying drawings. FIGS. 5 through 7 illustrate a typical image forming apparatus to which the embodiment of the invention is applied. Specifically, FIG. 5 is a block diagram showing how a remote printer (image forming apparatus) is connected to the embodiment; FIG. 6 is a perspective view of the remote printer; and FIG. 7 is a schematic view outlining the constitution of the remote printer.

As shown in FIG. 5, the remote printer comprises an ESS (interface) 20 that converts image data $DT_0$ transferred from a host computer 10 into image data DT of a predetermined format ready for transmission, and an IOT 30 that reproduces images on a recording sheet, not shown, in accordance with the image data DT from the ESS 20.

The ESS 20 is positioned above a housing 31 of the IOT 30 as shown in FIG. 6. The ESS 20 is equipped with a CRT display 21, a keyboard 22 used to select and execute various working menus, and a floppy disc unit 23 for admitting prerecorded image data from a floppy disc, not shown. Reference numerals 41 through 44 represent sheet feed cassettes. Reference numeral 48 stands for an ejected sheet tray, 53 for an intermediate tray and 92 for a control panel.

The constitution of the IOT 30 in the above remote printer will now be described along with the print operation of the machine. As depicted in FIG. 7, the image data transferred from the ESS 20 is converted by an ROS (raster output scanner) unit 32 into an optical signal for scanning exposure over a photosensitive drum 33. The ROS unit 32 scans the photosensitive drum 33 axially with a laser beam Bm reflected by a polygonal mirror 35. The laser beam Bm is emitted by a semiconductor laser 34 oscillating in accordance with the image data DT. Thus the photosensitive drum 33 is scanned for exposure of the image representing the image data DT.

The photosensitive drum 33 is charged in advance to a predetermined level of potential by a primary charging unit 38. The photosensitive drum 33 is then scanned by the ROS unit 32 for exposure of an image, so that an electrostatic latent image is formed over the drum surface. The electrostatic latent image is developed into a toner image by a developing unit 39 using black toner. Then the toner image is subjected to charges of a charging unit 40 to lower the toner potential in preparation for image transfer.

Thereafter, the toner image formed on the photosensitive drum 33 is transferred by charges of a transfer charging unit 45 to recording paper P. The recording paper P is a recording sheet of a predetermined size fed from one of the sheet feed cassettes 41, 42, 43 and 44 set inside the printer. With the toner image transferred, the recording paper P is separated from the photosensitive drum 33 by charges of a separation charging unit 46. The separated recording paper P is transported to a fixing unit 47 whereby the toner image is fixed on the recording paper P. In normal recording mode, the recording paper P with the toner image transferred and fixed thereon is ejected onto the ejected sheet tray 48. An ejection port through which the recording paper P is ejected has a sheet sensor 49 that detects the paper P.

A cleaner 50 cleans the surface of the photosensitive drum 33, removing the residual toner and paper powder therefrom. Illumination by a discharge lamp 51 removes the residual charge from the drum surface in preparation for the next image recording process.

In double-sided recording mode or in single-sided overlay recording mode, the recording paper P with a toner image fixed thereon is not ejected directly onto the ejected sheet tray 48 but transported back to the image recording section via a transport path 52 and an intermediate tray 53, either as currently oriented or after being reversed. Then a second toner image is recorded on the recording paper P. With the second toner image again transferred and fixed, the recording paper P is ejected finally onto the ejected sheet tray 48.

Figure 8:
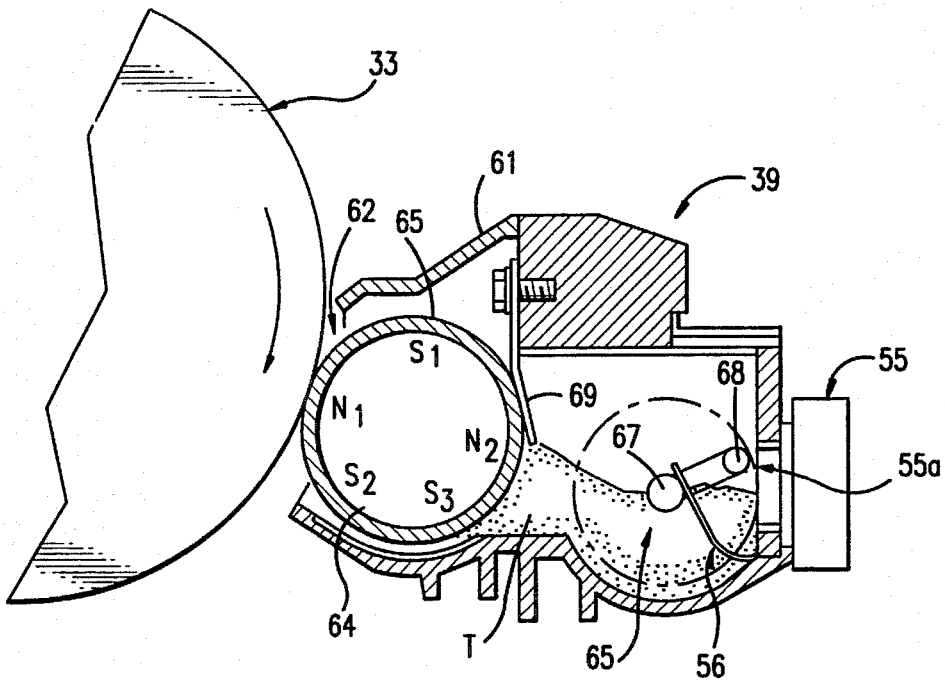
FIG. 8 is a cross-sectional view of a typical developing unit equipped with the toner sensor of the embodiment.
Figure 9:
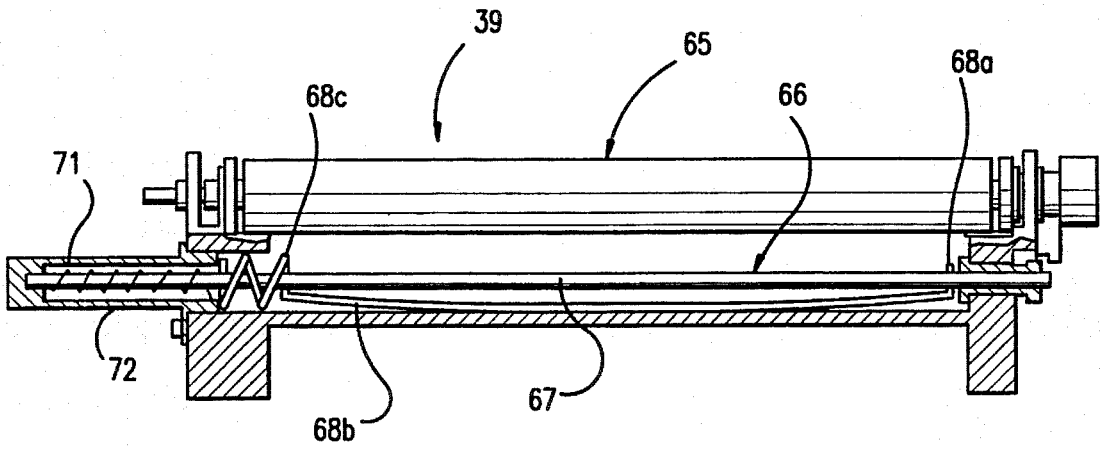
FIG. 9 is another cross-sectional view taken from a different angle of the developing unit in FIG. 8.

FIGS. 8 and 9 illustrate a typical developing unit having the toner sensor according to the equipment. Specifically, FIG. 8 is a cross-sectional view of a typical developing unit equipped with the toner sensor of the embodiment, and FIG. 9 is another cross-sectional view taken from a different angle of the developing unit in FIG. 8.

In FIG. 8, a developer housing 61 has an approximate cross section of a horizontally reversed "C" shape. The developer housing 61 has an opening 62 on the side of the photosensitive drum 33. Inside the opening 62 of the developer housing 61 is a rotatably furnished developing roller 65 that has a magnet roll 64 installed fixedly inside. Inside the developer housing 61 is also an agitator 66 that supplies the developing roller 65 with monocomponent toner T while agitating it. The agitator 66 comprises a shaft 67 supported rotatably on the side walls of the developer housing 61, and an agitating member 68 fixed to the shaft 67. As shown in FIG. 9, one end 68*a* of the agitating member 68 is fixed to one end of the shaft 67. The middle portion 68*b* of the agitating member 68 is curved extensively in the axial direction of the shaft 67. The other end of the agitating member 68 has a coil portion 68*c* that permits transport of the toner T.

One side wall of the developer housing 61 has an auger pipe 71 projected therefrom, as depicted in FIG. 9. The auger pipe 71 containing a rotatable auger 72 inside serves to draw the toner T from a toner supply unit 74, as will be described later. The auger 72 has part of it shared by the agitator 66. A plate-like member is wrapped around the shaft 67 of the agitator 66 in spiral fashion, the diameter of the wrapped member being smaller than that of the coil portion 68*c* of the agitating member 68.

As shown in FIG. 8, the toner T in the developer housing 61 is fed by the agitator 66 to the developing roller 65. The toner T is attracted to the developing roller 65 by the magnetic force of the magnet roll 64 inside the roller 65; the toner T is also transported as the developing roller 65 rotates. In this process, the toner T applied over the developing roller 65 is limited in thickness by a contact blade 69 protruding downward from the ceiling of the developer housing 61. Thus a coat of the toner T of a constant thickness is attached to the surface of the developing roller 65. Carried by the surface of the developing roller 65, the toner T is transported to the position close to the photosensitive drum 33. A predetermined developing bias applied to the developing roller 65 develops the electrostatic latent image over the surface of the photosensitive drum 33.

That wall portion of the developer housing 61 which comes opposite to the agitator 66 has a first toner sensor 55 comprising a piezoelectric element for detecting the presence or absence of the toner T. The first toner sensor 55 is mounted so that its round sensing surface 55*a* is flush with the wall surface of the developer housing 61. In operation, the first toner sensor 55 detects the presence or absence of the toner T using the piezoelectric element that vibrates differently depending on whether or not the toner T is in contact with the sensing surface 55*a*. The shaft 67 of the agitator 66 has a cleaning member 56 that can come into contact with the sensing surface 55*a* of the first toner sensor 55. As the agitator 66 rotates, the cleaning member 56 cleans the sensing surface 55*a* of the sensor 55.

Figure 10:
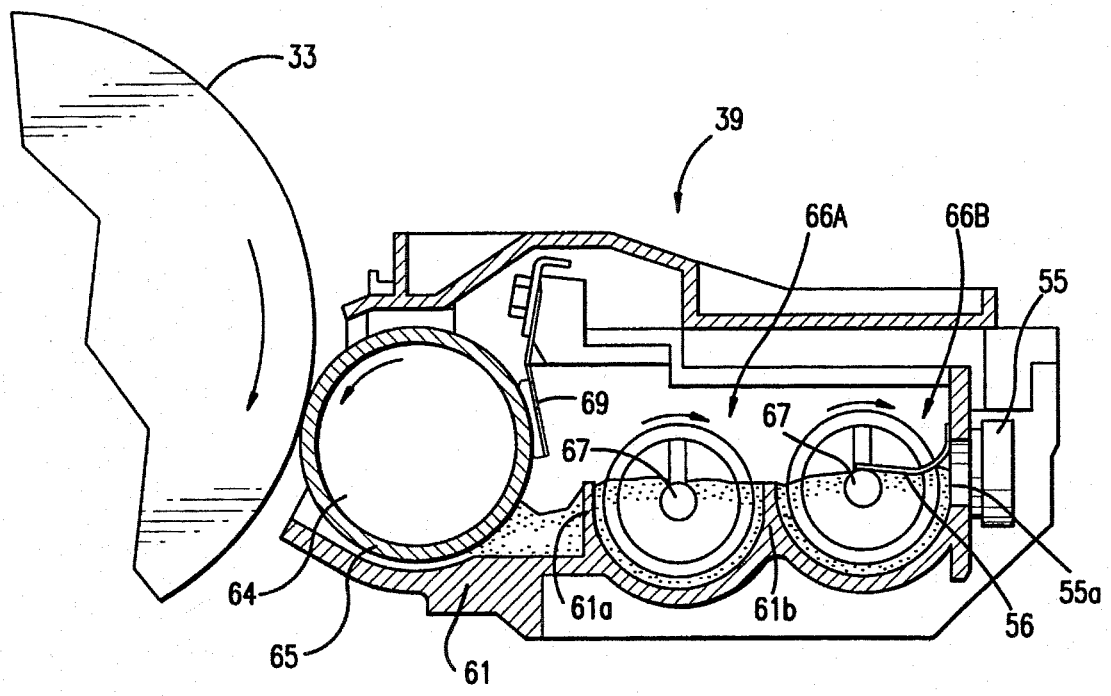
FIG. 10 is a cross-sectional view of another typical developing unit equipped with the toner sensor of the embodiment.
Figure 11:
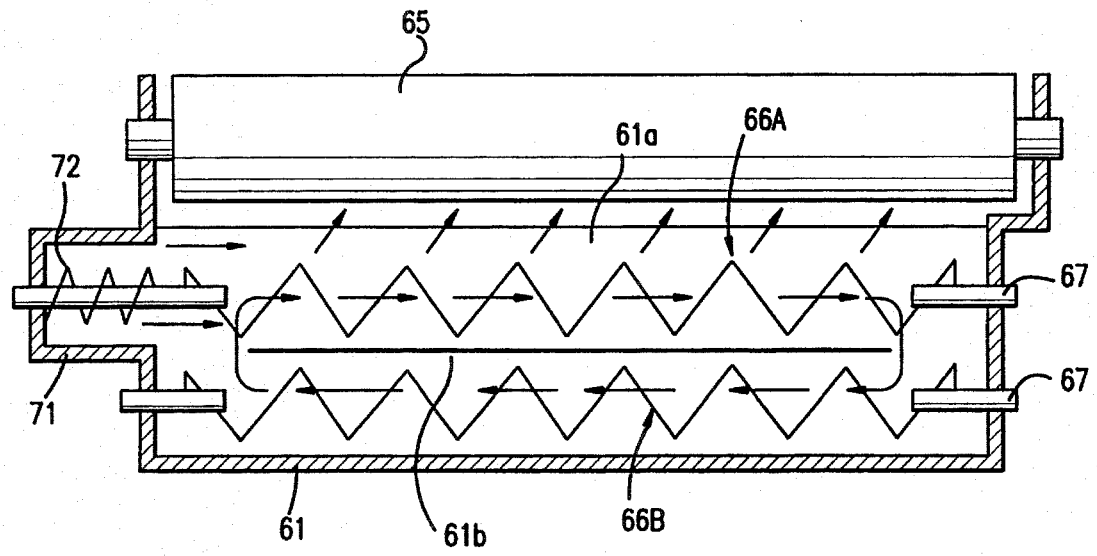
FIG. 11 is another cross-sectional view taken from a different angle of the developing unit in FIG. 10.

FIGS. 10 and 11 illustrate another typical developing unit having the toner sensor according to the invention. Specifically, FIG. 10 is a cross-sectional view of the alternative typical developing unit equipped with the toner sensor of the embodiment, and FIG. 11 is another cross-sectional view taken from a different angle of the developing unit in FIG. 10. It should be noted that those parts that appeared in the preceding example are designated by like reference characters and their descriptions are omitted where redundant.

In this example, the developer housing 61 contains partitions 61*a* and 61*b* inside. A first and a second agitator 66A and 66B are furnished rotatably opposite to the partitions 61*a* and 61*b*, respectively. The agitators 66A and 66B are each composed of a coil-like member interposed between right- and left-hand rotating shaft portions 67. The toner T fed to an auger 72 is subject to a component force stemming from the rotating first agitator 66A and directed toward the developing roller 65 (in the arrowed direction in FIG. 11). As a result, part of the toner T scales the partition 61*a* to reach the developing roller 65. The remaining toner T is transported to the second agitator 66B, and circulated back to the first agitator 66A.

Figure 12:
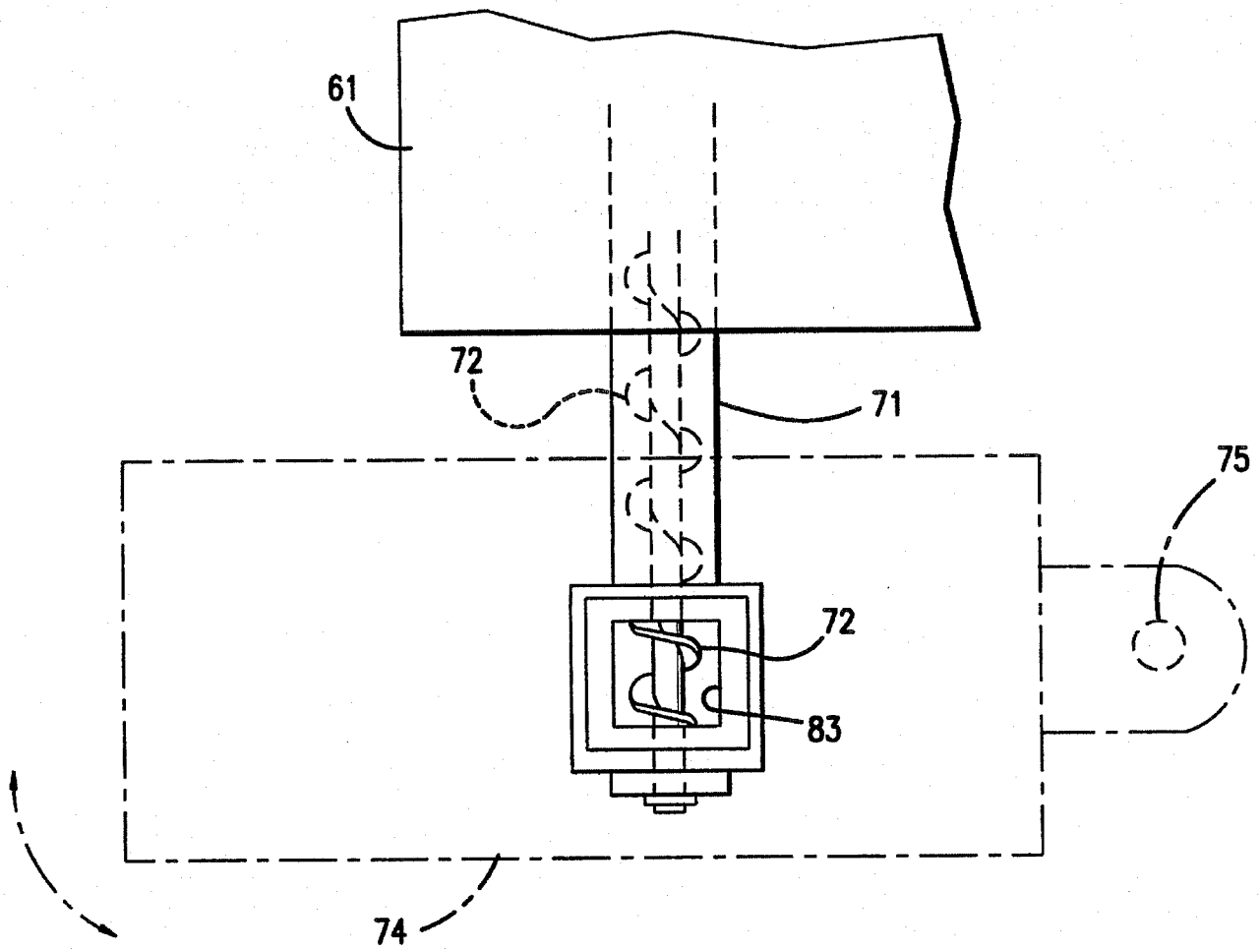
FIG. 12 is a plan view illustrating the relationship between a developer housing and a toner supply unit in the embodiment.
Figure 13:
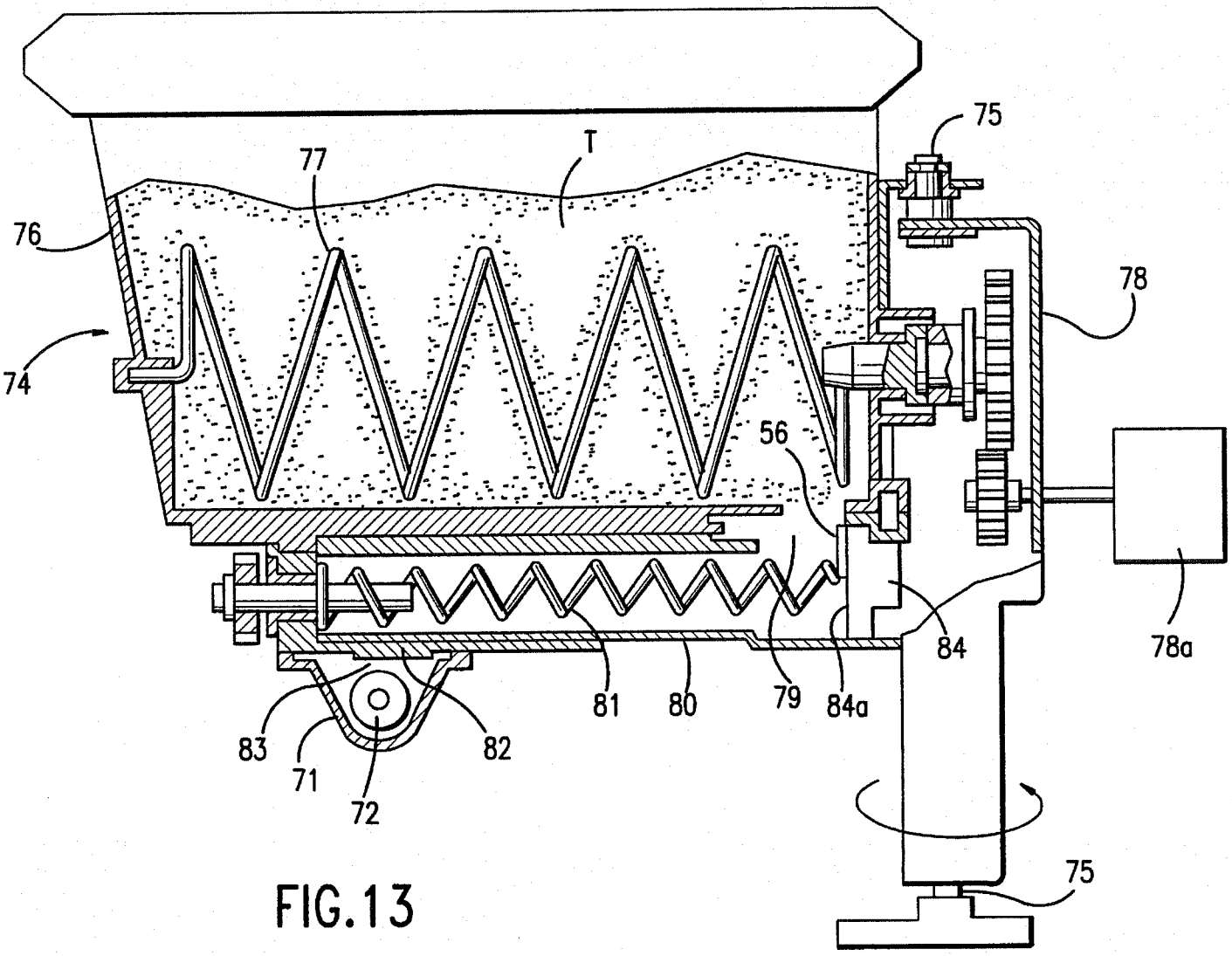
FIG. 13 is a cross-sectional view of the toner supply unit in the embodiment.
Figure 14:
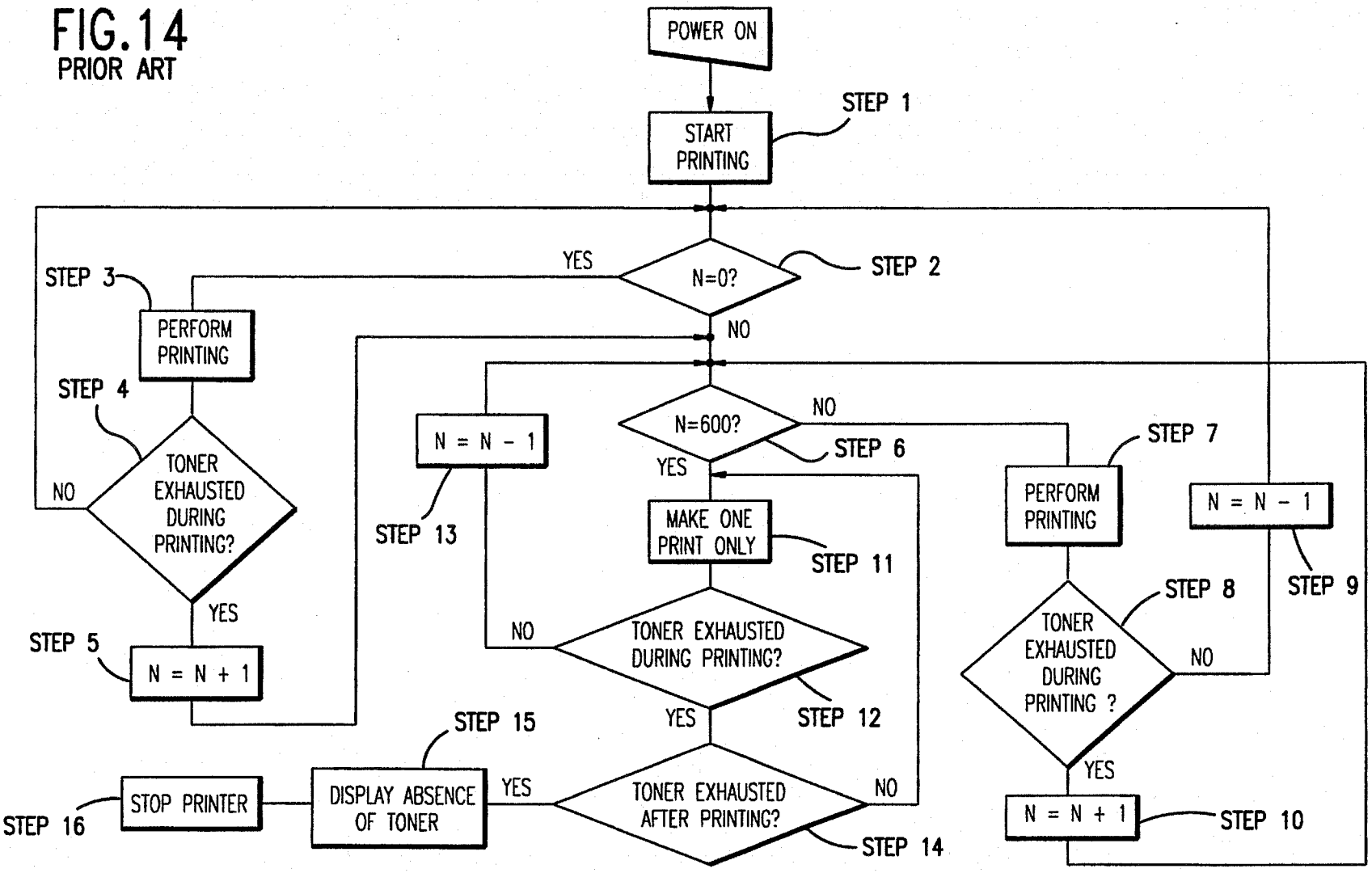
FIG. 14 PRIOR ART
FIG. 14 is a flowchart of steps in which the typical conventional empty toner sensor operates.

FIG. 12 is a plan view illustrating the relationship between the developer housing 61 and the toner supply unit 74 in the embodiment, and FIG. 13 is a cross-sectional view of the toner supply unit 74 for feeding the toner T into the developer housing 61. As shown in FIG. 12, the toner supply unit 74 is located on one side of the developer housing 61. The toner supply unit 74 is rotatable horizontally on a rotating shaft 75 positioned at one end of the unit, as depicted in FIG. 13.

In FIG. 13, reference numeral 76 represents a toner box that accommodates toner. The toner box 76 is a box-like container containing the toner T, and constitutes a detachable cartridge to be set in the toner supply unit 74. The toner T is replenished easily by detaching the empty toner box 76 and setting a new toner box 76 in its place. A coil-like agitator 77 is furnished rotatably inside the toner box 76. In operation, the agitator 77 agitates the accommodated toner T at appropriate intervals in order to prevent blocking and other irregularities of the toner. With the toner box 76 set in the toner supply unit 74, the agitator 77 is driven by a driving unit 78 that is coupled operatively with one end of the agitator 77. The driving unit 78 is in turn activated by a dispensing motor 78*a*.

The bottom of the toner box 76 has an opening 79 through which the toner T is drawn out. The opening 79 is connected to a guide conduit 80 having a U-shaped cross section. Inside the guide conduit 80 is an auger 81 furnished rotatably for transporting the toner T coming down from the opening 79 of the toner box 76. The toner T is transported by the auger 81 through a supply port 82 at the bottom of the other end of the guide conduit 80 to an opening 83 of the auger pipe 71 protruding outside the developer housing 61. Through the opening 83 of the auger pipe 71, the toner T is transported by the auger 72 into the developer housing 61, as already mentioned.

Inside the toner supply unit 74 is a second toner sensor 84 which, like the first toner sensor 55, detects the presence or absence of the toner T. The second toner sensor 84 is attached to that side wall end of the guide conduit 80 which is located immediately below the opening 79 of the toner box 76. The round sensing surface 84*a* of the second toner sensor 84 is positioned flush with the side wall end of the guide conduit 80. The auger 81 is tipped with a sensor surface cleaning member 56 that contacts the sensing surface 84*a* of the second toner sensor 84. As the auger 81 rotates, the sensing surface 84*a* of the sensor 84 is cleaned by the cleaning member 56.

Figure 2:
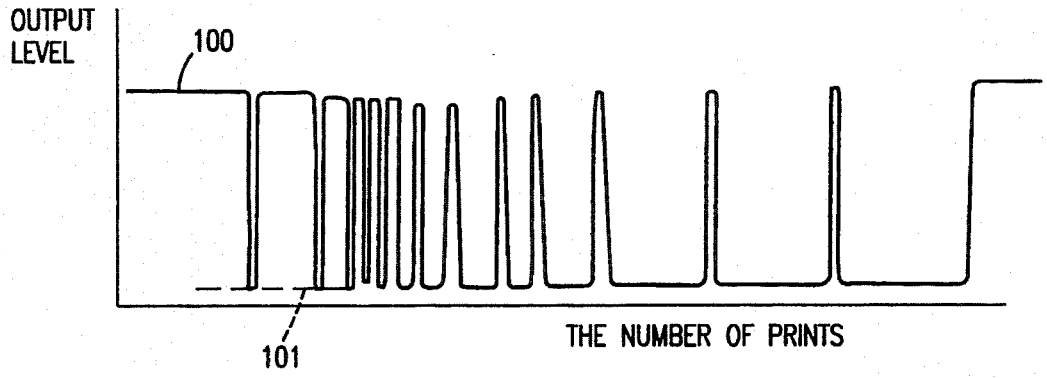
FIG. 2 is a waveform diagram illustrating a typical waveform of the signal from a toner sensor of the embodiment.

FIG. 2 illustrates a typical waveform of outputs from the toner sensor inside the developing unit. The high-level sensor output 100 is effected when toner is in contact with the sensing surface of the toner sensor; the low-level sensor output 101 is given when toner is not in contact with the sensing surface of the toner sensor. Each pulse flanked by the high and the low level is in synchronism with the cleaning operation on the sensor surface. A waveform region where pulse spacing is short indicates the state in which the toner level is close to the sensor surface, i.e., the developing unit is filled with toner. A waveform region where pulse space is long represents the state in which little toner is present near the sensor surface. This output pattern is observed because the sensing surface of the toner sensor is brought into contact with and separated from toner in synchronism with the cleaning operation on the sensor. For example, when the developing unit is filled with toner, a cleaning operation separates the sensing surface of the toner sensor temporarily from toner but the sensing surface is brought into contact with toner immediately after the cleaning operation. Thus the low-level signal is short. The developing unit has the toner box for feeding toner thereto. The supply of toner from the toner box to the developing unit may be carried out either periodically or as needed, i.e., when the low-level pulse output from the sensor has exceeded a predetermined period. If the toner sensor fails, the output pulse pattern of FIG. 2 does not appear; the output remains either at the high or at the low level. The constant high or low level output over a predetermined period or longer prompts the embodiment of the invention to recognize a sensor failure and to display an error indication and/or stop the machine. However, since a certain amount of toner still remains inside the developing unit, display of the error indication or the stopping of the machine is not effected immediately. That is, copies or output image signals are illustratively kept counted until a predetermined count value is reached. This arrangement allows a certain amount of image output to continue after the sensor failure.

Figure 1:
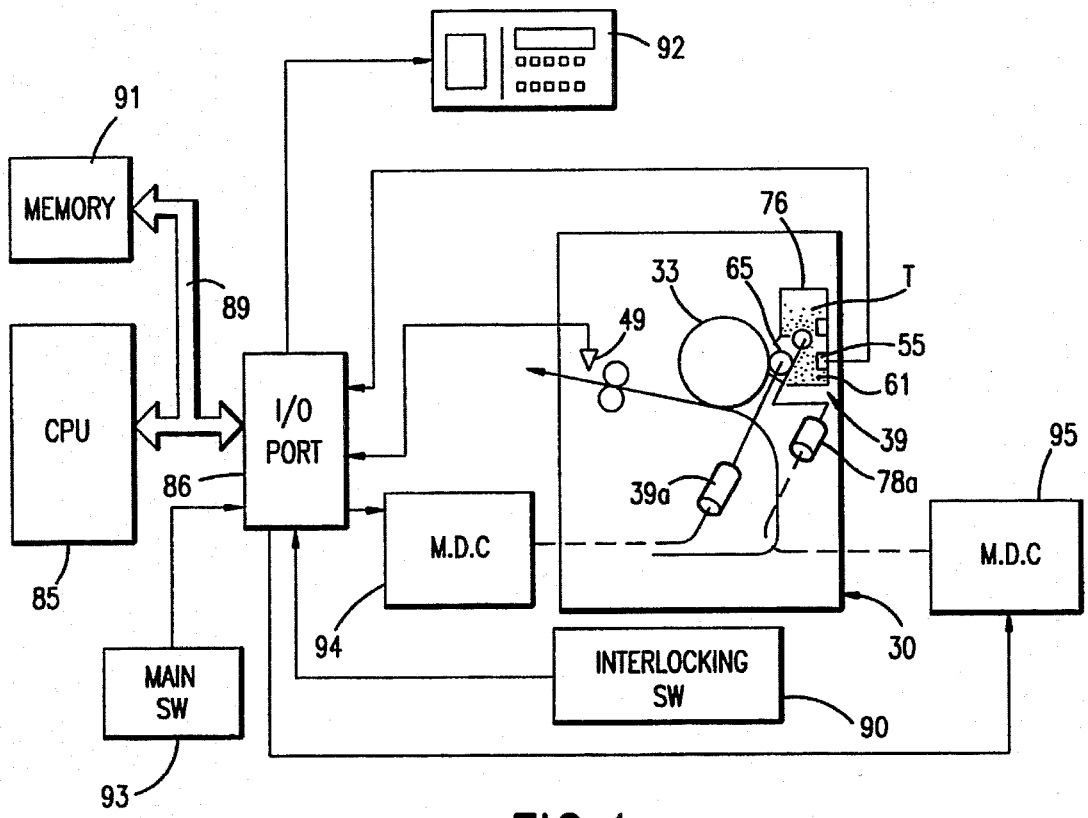
FIG. 1 is a block diagram of an error detection apparatus embodying the invention and for use with an image forming apparatus, the diagram highlighting the constitution of a control circuit in the embodiment.

FIG. 1 is a block diagram of the error detection apparatus embodying the invention and for use with the image forming apparatus, the diagram highlighting the constitution of a control circuit in the embodiment. In FIG. 1, reference numeral 30 is the IOT; 33 is the photosensitive drum; 39 is the developing unit; 39*a* is a developing roller driving motor; 49 is the sheet sensor; 55 is the first toner sensor; 61 is the developer housing; 76 is the toner box; 78*a* is the dispensing motor; 85 is a CPU; 86 is an I/O port; 90 is an interlocking switch for detecting the opening and closing of a cover, not shown, of the printer when the toner box 76 in the developing unit 39 is serviced; 91 is a nonvolatile memory for storing count values and the like; 92 is a control panel; 93 is a main switch; 94 is a motor driving circuit for the developing roller driving motor 39*a*; and 95 is a motor driving circuit for the dispensing motor 78*a*. The interconnections between the memory 91, the CPU 85, and the I/O port 86 are represented by 89.

The CPU 85 acts as the counting and control means of the embodiment, providing overall control of the operation of the remote printer. The CPU 85 admits signals from the first toner sensor 55, sheet sensor 49, interlocking switch 90 and main switch 93 via the I/O port 86. In turn, the CPU 85 outputs control signals through the I/O port 86 to the control panel 92, the motor driving circuit 94 of the developing roller driving motor 39*a*, and the motor driving circuit 95 of the dispensing motor 78*a*.

How the embodiment of the invention works for error detection will now be described with reference to FIGS. 2 and 3. FIG. 2 is a waveform diagram illustrating a typical waveform of the signal from the first toner sensor 55 of the embodiment, and FIG. 3 is a flowchart of steps in which the embodiment typically operates for error detection.

In FIG. 2, as mentioned, the detection signal from the first toner sensor 55 occurs either as a high level signal 100 or as a low level signal 101. The high level signal 100 is output when the toner T is in contact with the sensing surface of the toner sensor 55; the low level signal 100 is given when the toner T is absent from the sensing surface of the toner sensor 55. However, the high or low level signal 100 or 101 is not necessarily output when the toner T is simply present or absent in the developer housing 61. That is, the cleaning member 56, acting in synchronism with the agitator 66 to prevent toner deposit over the sensor surface, can cause the first toner sensor 55 erroneously to detect the presence or absence of the toner T as the agitator 66 rotates. With the toner T consumed every time a print is made, the first toner sensor 55 can also detect incorrectly the presence or absence of the toner upon a subsequent toner replenishing operation.

Figure 3:
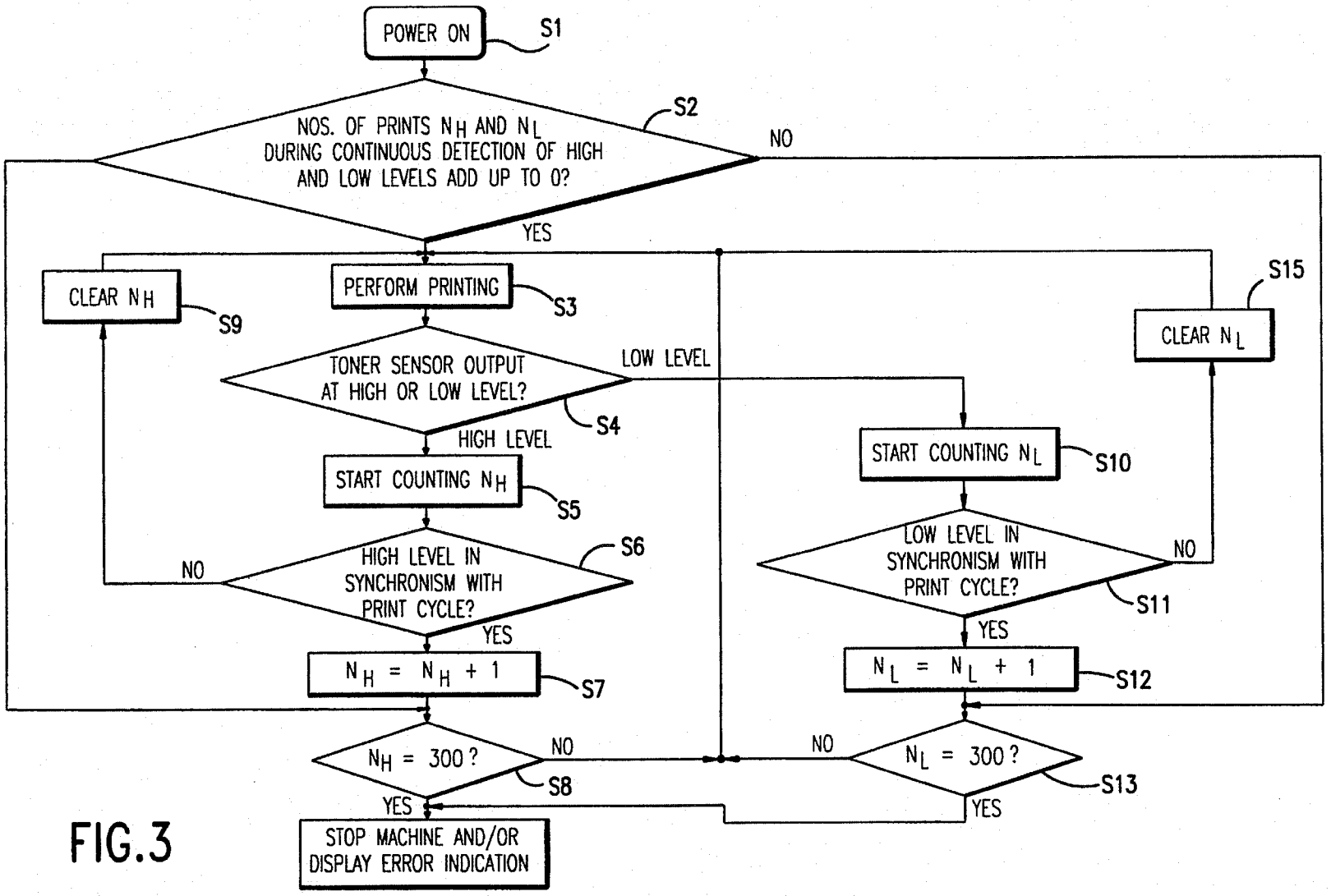
FIG. 3 is a flowchart of steps in which the embodiment typically operates.

Such potential trouble is bypassed by the embodiment which, as shown in the flowchart of FIG. 3, counts both the number of prints $N_H$ made when the high level signal 100 (i.e., toner-present signal) is detected continuously, and the number of prints $N_L$ given when the low level signal 101 (toner-absent signal) is detected continuously. When the sum of the two count value is has exceeded a predetermined value, the embodiment determines the presence or the absence of the toner.

Specifically, as shown in FIG. 3, the main switch 93 of the embodiment is turned on to apply power (step 1). In step 2, a check is made to see if the number of prints $N_H$ made when the high level signal 100 is detected continuously and the number of prints $N_L$ given when the low level signal 101 is detected continuously add up to either zero or at least one. If the sum of the print counts under the stated conditions is found to be zero, step 3 is reached in which a normal print operation is carried out.

In step 4, a check is made to see if the first toner sensor 55 detects a high level (for presence of toner) or a low level (for absence of toner). If a high level is detected, step 5 is reached in which the number of prints $N_H$ starts to be counted. In step 6, a check is made to see if the high level is in synchronism with the print cycle. The synchronism in this context means a period of printing (with the developing roller driving motor 39*a* in operation) in which the first toner sensor 55 keeps detecting the high level. Since the continuous detection of the high level is considered abnormal, the number of prints is incremented by 1 (step 7). In step 8, a check is made to see if the print count has reached a predetermined count value (e.g., 300 prints). When the predetermined count value is reached, the embodiment recognizes an error, displays an error indication and stops the machine.

If the high level is not found in synchronism with the print cycle in step 6 (i.e., in normal state), step 9 is reached in which the print count $N_H$ is cleared because the high or level signal is not detected continuously. With step 9 completed, step 3 is reached.

If the first toner sensor 55 detects a low level (for absence of toner), step 10 is reached in which the number of prints $N_L$ starts to be counted. In step 11, a check is made to see if the low level is in synchronism with the print cycle. Since the continuous detection of the low level is considered abnormal, the number of prints is incremented by 1 (step 12). In step 13, a check is made to see if the print count has reached a predetermined count value (e.g., 300 prints). When the predetermined count value is reached, the embodiment recognizes an error, displays an error indication and stops the machine. If the low level is not found in synchronism with the print cycle in step 11 (i.e., in normal state), step 15 is reached in which the print count $N_L$ is cleared because the high or low level signal is not detected continuously. With step 15 completed, step 3 is reached.

Again in step 2, the sum of the number of prints $N_H$ and the number of prints $N_L$ may add up to one or more because the high or low level has been continuous ever since power was applied. In that case, a "NO" decision in step 2 leads to step 8 or 13 with no intervening steps therebetween. After this, the same steps described above are carried out.

Figure 4:
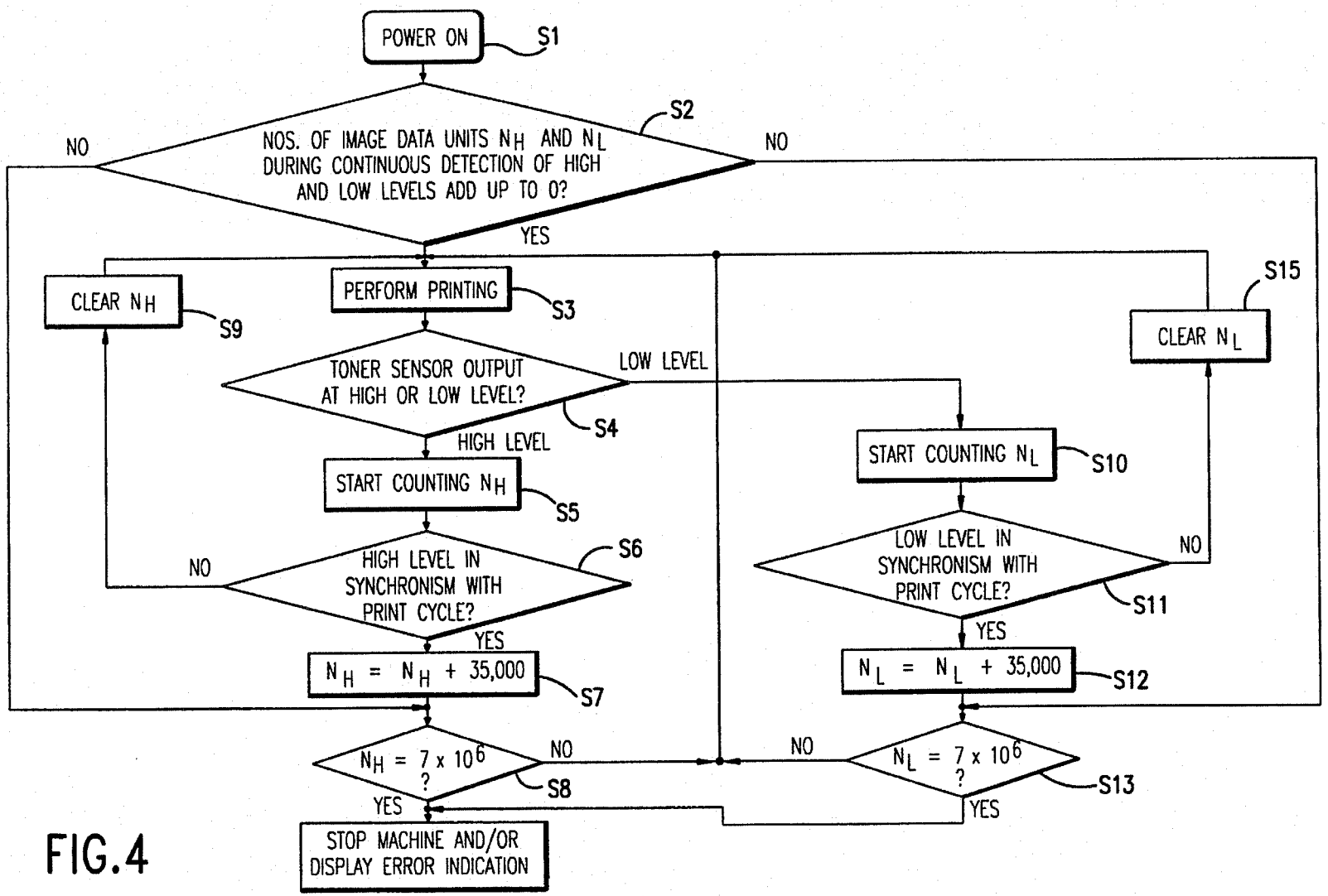
FIG. 4 is a flowchart of steps in which the embodiment operates in an alternative manner.

FIG. 4 is a flowchart of steps in which the embodiment operates in an alternative manner for error detection. In this example, the number of image data units is counted for error detection control instead of the number of prints. The flow of steps in FIG. 4 is basically the same as that in FIG. 3 except that the number of pixels is counted by the embodiment of the example in FIG. 4. For the counting operation, the image data and the image clock signal are input to a pixel counter via an AND circuit.

As described, the error detection apparatus according to the invention acts unfailingly to prevent the degradation of image quality or the destruction of component parts stemming from a toner sensor failing to detect correctly the presence or absence of toner in the developing unit in case of a failure of the toner sensor itself, a failed toner dispensing motor, a severed harness, an unplugged connector, or a failed PCB.

Although the description above contains many specificities, these should not be construed as limiting the scope of the invention but as merely providing illustrations of the presently preferred embodiments of this invention. For example, instead of the first toner sensor 55 in the developer housing 61 being utilized for the above embodiment, the second toner sensor 84 in the toner box may be employed for error detection. Another alternative is to use both sensors in combination.

Thus the scope of the invention should be determined by the appended claims and their legal equivalents, rather than by the examples given.

What is claimed is:

1. An error detection apparatus that detects a toner sensor error in an image forming apparatus, the image forming apparatus comprising:

a developer housing positioned opposite to a photosensitive body;

a toner box for supplying monocomponent toner to said developer housing;

a developing roller for developing an electrostatic latent image on said photosensitive body in said developer housing; and a toner transport and supply member for transporting and supplying said monocomponent toner to said developing roller;

said toner sensor being arranged for detecting either the presence or the absence of said monocomponent toner in at least one of said developer housing and said toner box;

said error detection apparatus that detects toner sensor error comprising:

first counting means for counting the number of at least one of prints and image signals while a toner-present signal is being detected continuously from said toner sensor;

second counting means for counting the number of at least one of prints and image signals while a toner-absent signal is being detected continuously from said toner sensor; and display and stopping means for stopping the operation of said image forming apparatus and displaying an error indication concurrently when a toner sensor error occurs if the sum of the values counted by said first and said second counting means has exceeded a predetermined value.

2. An error detection apparatus according to claim 1, wherein said first and said second counting means perform counting operations when one of said toner-present signal and said toner-absent signal is being detected continuously in synchronism with a print cycle.

3. An error detection apparatus that detects toner sensor error in an image forming apparatus, said error detection apparatus comprising:

a developing unit;

a toner sensor having a toner sensing surface furnished inside said developing unit, said toner sensor outputting continuously either a toner-present or a toner-absent signal depending on either the presence or the absence of toner contacting said toner sensing surface;

a cleaning member for cleaning said toner sensing surface periodically;

output image quantity counting means for counting the quantity of images output when one of said toner-present signal and said toner-absent signal is being output continuously from said toner sensor; and display and stopping means for at least one of stopping the operation of said image forming apparatus and displaying an error indication, if the quantity of the output images has exceeded a predetermined value.

* * * * *